United States Patent [19]

Haugh et al.

[11] Patent Number: 4,496,652

Date of Patent: Jan. 29, 1985

[54] SILVER HALIDE CRYSTALS WITH TWO SURFACE TYPES

[75] Inventors: Eugene F. Haugh; Earle L. Kitts, Jr., both of Wilmington; Daniel J. Mickewich, Arden, all of Del.

[73] Assignee: E. I. Du Pont de Nemours and Company, Wilmington, Del.

[21] Appl. No.: 159,798

[22] Filed: Jun. 16, 1980

Related U.S. Application Data

[63] Continuation of Ser. No. 972,972, Dec. 26, 1978, abandoned.

[51] Int. Cl.[1] ..... G03C 1/28; G03C 1/02

[52] U.S. Cl. ..... 430/569; 430/567; 430/596; 430/603; 430/605

[58] Field of Search ..... 430/567, 569, 596, 603, 430/605

[56] References Cited

U.S. PATENT DOCUMENTS 3,736,144 5/1973 Nagae et al. .
3,957,488 6/1976 Klötzer et al. .

FOREIGN PATENT DOCUMENTS 1027146 4/1966 United Kingdom .
1462212 1/1977 United Kingdom .

OTHER PUBLICATIONS

E. Moisar, et al.—The Influence of Growth Conditions on Crystalline Behavior of Silver Halide, Bunsengesellschaft für Physikalische Chemie, Berichte 67, pp. 949-957.

S. Suzuki, et al.: Imaging Materials and System S Paper B-1 SPSE Tokyo Symposium, 1973.

Shiozawa, "Electron Microscopic Study on Conversion of Silver Halides. II Conversion of AgBr to AgCl and AgCl to AgBr," Bull. Soc. Photog. Sci. & Technology of Japan, No. 22, Dec. 1972, pp. 14-20.

*Primary Examiner*—Won H. Louie

[57] ABSTRACT

Novel silver halide crystals useful for both negative and positive photographic elements are produced by balanced double jet precipitation. Using that process, silver halide adds preferentially to the (111) surfaces of tetradecahedral silver bromide or iodobromide crystals to form cubic crystals which have corners containing a different silver halide from that in the lateral surfaces. In a specific embodiment, a crystal has corners composed of silver bromochloride, while the crystal substrate consists of highly photosensitive silver iodobromide.

3 Claims, 4 Drawing Figures

SILVER HALIDE CRYSTALS WITH TWO SURFACE TYPES

This is a continuation of application Ser. No. 972,972 filed Dec. 26, 1978, abandoned.

DESCRIPTION

1. Technical Field

This invention relates to silver halide crystals, and their use in photographic film, and in particular, to cubic crystals grown from tetradecahedra where the corners are of different silver halide composition than the base crystal. The crystals of the present invention thus have two surface types.

2. Background Art

Investigations concerning regular-shaped crystals useful in photography have employed a technique known as balanced double jet precipitation wherein separate streams of silver nitrate and alkali metal halide are introduced into a stirred gelatin solution and the process is controlled to regulate the type of silver halide crystals which result. By proper adjustment during the initial flow or "seeding" period and the subsequent growth period, it is possible to grow regular and uniform particles which have come to be called monodisperse or homodisperse crystals or grains.

The formation of homodisperse cubic crystals from tetradecahedra was disclosed by E. Moisar and E. Klein, *The Influence of Growth Conditions on the Crystalline Behavior of Silver Halides* Bunsengesellschaft für physikalische Chemie, Berichte 67 949-957 (1963), No. 9/10. Maintaining low bromide ion concentration promoted preferential growth of silver bromide on the (111) surfaces of pure silver bromide. High bromide ion concentration is required to produce the tetradecahedra having (111) surfaces as opposed to the form of silver bromide which would consist of only (100) surfaces. This reference deals only with pure crystals and contains no disclosure of the mixed system of the present invention.

Numerous references to core-shell structures for silver halide grains exist in the literature. Typically, the core is coated over its entire surface with one or more layers or "shells" of a different silver halide, with no concept of preferentially depositing a different silver halide onto the (111) surfaces of a silver halide tetradecahedron.

It has long been known to persons skilled in photographic science to vary halide ratios and to make use of both sensitized and unsensitized core-shell emulsions. The unique crystals of the present invention, however, have not been described.

S. Suzuki and B. Veda in paper B-1 in *Imaging Materials and Systems*, 1973 SPSE Tokyo Symposium, disclose growing silver chloride on rounded corners of silver bromide by a physical ripening process with the recognition that the corners could be composed of (111) surfaces. The procedures involved only pure systems for the purpose of academic research, with no disclosure that useful or novel photographic results could be obtained from such systems.

SUMMARY OF THE INVENTION

It is an object of this invention to provide a process for preparing a novel type of silver halide crystal or grain in which the corners and body differ in halide composition, which structure results in beneficial photographic properties. The preferred crystal or grain consists of silver bromide or iodobromide tetradecahedra having a different silver halide, viz a chloride or bromochloride mixture grown on the (111) faces to form a cube.

It is a further object of this invention to provide either negative or positive working photographic silver halide compositions, employing for that purpose the aforesaid novel crystal or grain structure having improved photographic properties.

These objects are achieved by a process in which novel silver halide crystals useful for both negative and positive photographic elements are produced by balanced double jet precipitation. In that process, silver halide adds preferentially to the (111) surfaces of tetradecahedral silver bromide or iodobromide crystals to form cubic crystals which have corners containing silver halide differing in composition from the lateral surfaces. A precipitation pAg of from about 8 to about 9 is maintained to produce the tetradecahedra and a pAg of 6 to 8 is maintained during formation of the cube corners. A crystal may have surfaces of both silver bromide and silver chloride.

In a preferred structure, the crystal has corners of silver bromochloride, while the bulk consists of highly photosensitive silver iodobromide.

DETAILED DESCRIPTION OF THE INVENTION

Figure 1:
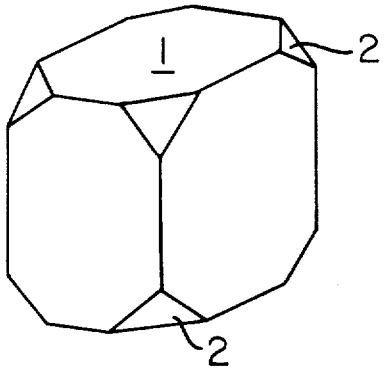
FIG. 1 depicts the original crystal which has (100) surfaces 1 and (111) surfaces 2.

The present invention produces hybrid crystals with the silver halide composition of the corners comprising as little as 3% by weight of the total silver halide content of the crystal. Since the corners may be silver chloride while the body is silver bromide, it is possible to effectively limit certain sensitization processes to the area of these corners where reactions may take place in or on silver chloride in preference to silver bromide. This localization of sensitized processes improves photosensitivity. An illustration would be the selective chemical fogging of the silver chloride corners of the cubic crystals of the present invention, which would limit the fog centers to only the limited and well-defined corner locations giving a direct positive emulsion with improved speed. Using crystals with only a very small silver chloride percentage on the corners, it is possible to provide uniform crystals which respond to sensitization as if they were silver chloride but which develop, fix and wash during photographic processing as if they were silver bromide. The word "hybrid" is intended to mean crystals of the present invention which have different silver halide compositions for the corner and body portions and combine the photosensitive and physical characteristics of these in one structure.

Inasmuch as the crystals of the present invention are monodisperse, the same ratio of body to corner surface area and silver halide volume will be maintained for substantially all the crystals. Surface and halide differences thus are constant for almost all crystals, whereas prior art crystals have these variations statistically distributed over the total crystal population rather than fixed and exact for most individual crystals.

It has been found that novel silver halide crystals are produced by (1) precipitation of a crystal which contains both (111) and (100) surfaces and (2) further precipitation of a different composition or compositions which preferably add to the (111) surface to produce the final crystal. Such crystals may become part of a photographic element after appropriate treatment and subsequent coating on a support.

It is particularly preferred that the silver halide useful for forming the (111) and (100) surfaces be silver bromide containing 20% or less silver iodide and that the silver halide which adds to the (111) surfaces be pure silver chloride, pure silver bromide or a mixture of these.

It is possible to produce crystals with both (100) and (111) faces by using pure silver bromide, or silver iodobromide with up to 20% iodide, by maintaining the precipitation pAg between about 8 and about 9. The useful pAg range depends somewhat on iodide content, pH, and the presence of crystal growth modifiers such as ammonia. Low pAg favors the growth of cubes and high pAg favors the growth of octahedra. Within the pAg range favoring tetradecahedra, increasing pAg causes an increase in the ratio of (111) surface area to (100) surface area. To minimize this ratio and achieve the smallest practical ratio of corner to body surface areas, the tetradecahedra are grown at a pAg just slightly too high for perfect cubes. Growth at such a pAg would normally result in rounded cubes; however, by using high agitation, very careful pAg control and relatively low precipitation temperatures, it is possible to grow cubes with only the apex of each corner missing to reveal small well-defined (111) faces. Then silver chlorobromide is precipitated at pAg of about 6.5 to grow preferentially on the (111) faces to complete the cube. Precipitation temperatures of from 35° C. to 50° C. give acceptable results. Temperatures of from 37° C. to 44° C. are particularly preferred. High stirrer speeds are required to insure rapid mixing in order to form the crystals of the present invention. Stirrer speeds above 250 rpm are preferred, but the speed must not be so high that excessive foam or heat will interfere with the process. A pAg controlled apparatus useful for the present invention is disclosed by Parthemore in U.S. Pat. No. 3,999,048.

A more detailed discussion of the drawings will aid in describing the preferred embodiment of the present invention.

Figure 2:
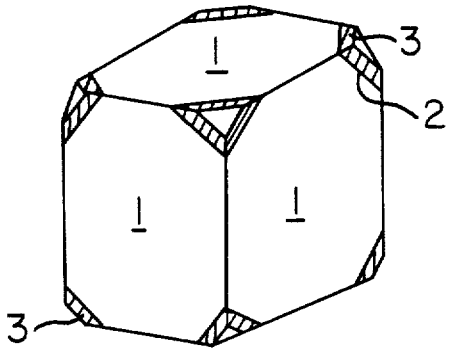
In FIG. 2, partial growth of the new silver halide crystal has taken place on the (111) surfaces.
Figure 3:
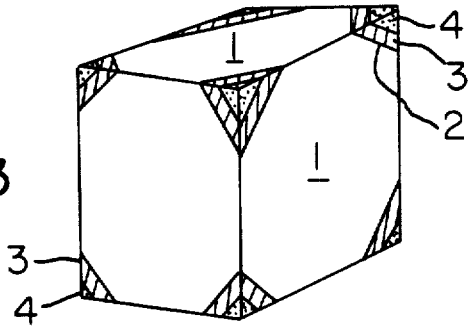
In FIG. 3, the growth is complete, resulting in a cube with only (100) surfaces, and these of different composition depending on position.

FIGS. 1, 2 and 3 represent the crystal growth process which characterizes the present invention. FIG. 1 illustrates the original silver halide crystal having 8 corners, each corner 2 being a (111) surface. FIG. 1 is not meant to limit the invention, since the surface ratio between a typical corner and an adjacent (100) plane 1 could vary over a wide range. In FIG. 2, each of the (111) planes is covered by a silver halide deposit 3 of a new and different silver halide. It is obvious that with proper control, it would be possible to grow multiple layers on the corners or to have a gradation of halide content. In FIG. 3, one or more of the corners has been completed by the addition of another halide layer 4 onto now intermediate layer 3.

Figure 4:
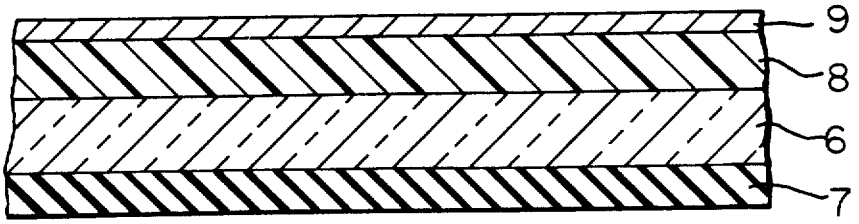
FIG. 4 depicts a preferred film structure in which the crystals of the present invention may be employed. The crystals are used in layer 8 which represents a photographic emulsion layer coated on a support 6 and having a protective overcoat 9 with an optional auxiliary or backing layer 7 coated on the reverse side of the support.

FIG. 4 illustrates the preferred film structure in which the crystals of the present invention may be used. Support 6 is preferably polyethylene tetraphthalate having a subbing layer which makes it receptive to coating on the surface, as described in Alles U.S. Pat. No. 2,779,684. Optional backing or auxiliary layer 7 may be necessary for antistatic or antihalation protection, proper machine transport properties, etc. The other side of support 6 is coated, successively, with (a) photosensitive layer 8 containing the novel crystals of the present invention as a gelatino-silver halide emulsion and (b) protective overcoat or antiabrasion layer 9.

Silver halide crystals which can be prepared using the growth techniques of the present invention include silver bromide having compositional differentiation between body and corner. These include mixed halide compositions, such as silver iodobromide with silver chlorobromide, silver bromide with silver chloride, silver iodochlorobromide with silver bromochloride, and other multiple halide mixtures meeting the criteria of a first composition forming a crystal with both (111) and (100) faces and a second composition adding to the (111) face without otherwise disrupting the crystal structure. It must be recognized that if, at the conclusion of an addition step, the (111) faces still remain, then it will be possible to again preferentially precipitate additional silver halide of similar or new composition.

Heavy metal ions such as thallous, lead, rhodium, and gold may be present during part or all of the precipitation as long as they do not interfere with the tetrahedral-to-cubic shape change of the present invention.

Once precipitation has been completed, the crystals may be washed by any of the known techniques to allow the removal of excess salts. Coagulation washing is the preferred method of treatment, although the substitution of new protective colloids for gelatin may require that other techniques such as ultrafiltration be used.

Preferred emulsions produced by the balanced double jet precipitation method of the present invention are monodisperse, i.e., silver halide emulsions having a narrow grain size distribution in which a predominant number of the crystals have substantially the same size or volume. For the purpose of this invention, the grain size distribution may be expressed by $\alpha$ (alpha) values, defined and determined as described on page 76 of Mees-James, "The Theory of the Photographic Process", The MacMillan Company, New York (1966). Thus, $\alpha$ is "the projection on the log size axis of the straight line portion of the percentage cumulative curve of the distribution extended to 0% and 100%" and a monodisperse emulsion is one wherein $\alpha$ is about 0.5 or less. Grain size distribution may be determined by the electrolytic reduction method described by Holland and Sawers in *Photographic Science and Engineering*, Vol. 17, 295–8 (1973).

In place of gelatin or chemically-modified gelatin, other natural or synthetic water-permeable organic colloid binding agents can be used. Such agents may be derived from polyvinyl alcohol, acetate, ether or acetal, while useful compositions might include polymers containing acrylates, methacrylic acid, or styrene; or modified hydrolyzed gelatin as described in U.S. Pat. No. 3,778,278 "Photographic Gelatino-Silver Halide Emulsions Containing Hydrolyzed Modified Gelatin, and a Process for Their Manufacture".

Sulfur sensitizers containing labile sulfur, e.g., allylisothiocyanate, allyl diethyl thiourea and sodium thiosulfate may be used, as well as the polyoxyalkylene ethers and the polyglycols. Other nonoptical sensitizers may be used, such as amines and metal salts. Sensitizing and desensitizing dyes known for both negative and direct positive emulsions may also be used.

Fogging agents useful in preparing direct positive emulsions include amine boranes, boron hydrides, tin, gold and other reduction agents.

The emulsions can contain known antifoggants or stabilizers, e.g., 6-nitrobenzimidazole, benzotriazole, tetraazaindenes, etc., as well as the usual hardeners, e.g., chrome alum, formaldehyde, dimethylol urea, mucochloric acid, glyoxal, etc. Other emulsion adjuvants may include covering power polymers, matting agents, plasticizers, toners, latices, optical brightening agents, surfactants, and the like.

It is a surprising result that the crystals of the present invention show enhanced response when used in either a negative or positive working emulsion, since recent disclosures of novel crystals have been limited to one or the other mode.

It is known that defects in the crystal structure, which include the deliberate addition of impurities, are responsible for enhancement of photographic response. It is evident from electron micrographs of crystals of the present invention that a boundary exists between the body and corner portions. It is also possible to vary this boundary area by operating within the present invention. Crystal defects would be expected to occur along this boundary due to a change in silver halide composition. Thus, it is possible by practice of the present invention to increase or decrease both the number and location of crystal defects by controlling how far inside the crystal structure the boundary layers may extend and what differences in halide content exist. It is also possible to selectively include impurities in either the body or corners of these cubic crystals, or to introduce impurities into both.

The following examples illustrate the present invention, of which Example 1 represents the best mode envisioned.

EXAMPLE 1

Negative Emulsion

With constant stirring of 275 rpm by a 3-blade stirrer, 300 g of photographic grade lime-processed bone gelatin was added to 10 l of distilled water at 20° C. After stirring for 10 minutes the temperature was increased to 49° C. and held until the gelatin was completely dissolved. The temperature was then adjusted and held at 38° C. 1200 g of ammonium nitrate were added. Probes in the gelatin solution gave a pH measurement of 5.54 and a pAg of 7.2. Then 12 ml of 12.8N ammonium hydroxide was added. After the addition of 10 ml of 1N KBr the pAg was 8.3.

An automated precipitation apparatus simultaneously fed silver nitrate and alkali halide solutions into the gelatin solution via variable speed positive displacement gear pumps; this allowed the process to be controlled to give constant pAg control.

The silver nitrate solution was 3N while the alkali halide was a 3N ammonium bromide solution containing 4% potassium iodide. This equipment could be set to automatically maintain a preset millivolt value, using a feedback loop from a probe which signals the silver nitrate pump to vary its speed to control to the proper millivolt value. Prior to starting, 11 l of the halide solution was added to the "halide container", 11 l of silver nitrate solution to the "silver container", and the silver ion concentration setting was placed at +80 mv or a pAg of 8.3. The halide delivery for the first 15 minutes of precipitation was 25 ml/min. This was then continuously increased over a 6 min. period to reach 200 ml/min. The precipitation was continued for 37 minutes to produce 30 moles of silver halide. Electrolytic particle size measurements showed that the monodisdisperse grains produced had a mean grain volume of 0.035 $\mu m^3$ and an $\alpha$ of 0.21.

The emulsion temperature was lowered to 20° C. and the pH was lowered to 2.0 with 3N sulfuric acid. Then polyvinyl alcohol o-sulfobenzaldehyde acetal was slowly added to coagulate the emulsion. After settling, the water containing the salts was removed by decantation. For further removal of unwanted salts, 20 l of distilled water was added with stirring to the emulsion, which was then allowed to settle and the wash water removed by decantation. After washing, sufficient dilute sodium hydroxide was added to adjust the pH to 6.0 and the emulsion was redispersed by stirring. Then 1700 g of gelatin was added and allowed to swell for 10 minutes at 20° C. After 15 minutes the temperature was increased to 49° C. and held for 15 minutes. The temperature was then reduced to 30° C.

A portion of this emulsion was tested without further precipitation and serves as the control. An equivalent portion of the emulsion was treated as described below to illustrate the practice of the present invention.

A 430 g portion of the emulsion at 35.7% silver analysis was diluted to 9% silver analysis to give 1706 g which was placed in a similar but smaller scale precipitation apparatus. The precipitation solutions used for growing the corners were 3N silver nitrate and a solution obtained by mixing 170 ml 3N ammonium chloride with 43 ml 3N ammonium bromide. This precipitation was carried out at a pH of 6.0 and a pAg of 6.5 at a temperature of 35.5° C. The silver nitrate and mixed ammonium halide solutions were simultaneously added for 25 minutes at the rate of 1 ml/min. and then were added for 5 more minutes at a rate of 5 ml/min. while maintaining a pAg of 6.5.

After completion of this second precipitation reaction, the average grain volume was determined to be 0.038 $\mu m^3$ with an $\alpha$ of 0.21. Electron micrographs comparing the control emulsion with the example of the present invention show that the addition took place only on the corners of the original crystals. Thus the silver halide content of the grains was increased, as indicated by the final mean value of 0.038 compared with the original 0.035, but since the $\alpha$ value remained the same there was no change in the monodispersity of those crystals.

Equivalent portions of both the control and experimental emulsion were conventionally sensitized with gold thiocyanate and sodium thiosulfate at pH 6.0 and pAg 6.5 at a temperature of 57° C. for a sufficient period to achieve maximum sensitivity. When tested under identical exposure and processing conditions it was found that the crystals of the present invention had more than twice the speed of the control with a lower base plus fog, i.e., 0.13 versus 0.37.

Direct Positive Emulsion

With constant stirring at 350 rpm by a 3-blade stirrer, 30 g of photographic grade lime-processed bone gelatin was added to 800 ml of distilled water at 25° C. After stirring for 10 minutes the temperature was increased to 44° C. and held until the gelatin was completely dissolved. The temperature was then adjusted and held at 40.5° C. Probes in the gelatin solution gave a pH measurement of 5.9 and a pAg of 6.7. Automated precipitation control was used as with the negative example, except the halide delivery rate was controlled while the silver delivery rate was held constant.

The silver nitrate solution was 3N. The first halide solution was a 3N potassium bromide solution containing 1.5% potassium iodide. The second halide solution was 3N, containing a 1:4 molar ratio of potassium bromide:potassium chloride. This equipment could be set to automatically maintain a preset pAg (millivolt) value, using a feedback loop from a probe which signals the halide solution pump to vary its speed control to the proper millivolt (pAg) value. The silver nitrate solution delivery rate at the start of the precipitation was 3.0 ml/min. This was increased after 10 min. to reach 10 ml/min. Prior to starting, 600 ml of the first halide solution was added to the halide container, 510 ml of silver nitrate solution was added to the silver container, and the silver ion concentration setting was placed to control at a pAg of 8.6. The solution delivery pumps were stopped when the silver nitrate solution ran out and a sample was taken.

Then 34 ml of 3N silver nitrate solution was placed in the silver container, and the halide container was replaced by one containing 100 ml of the second halide solution. Precipitation was resumed at a silver nitrate solution delivery rate of 1.0 ml/min. with halide solution flow controlled to maintain a pAg of 6.5. After 10 minutes, the silver nitrate solution flow rate was increased slowly over a one minute period to a rate of 3.0 ml/min., and precipitation continued until the silver nitrate solution supply was exhausted. Then the pumps were stopped and a sample taken for electron microscopy and particle size analysis.

The mean grain volume was 0.007 $\mu m^3$ with an $\alpha$ of 0.23. Electron micrographs of the cubic crystals revealed a phase transition between the tetradecahedral bodies and corners. FIGS. 4A and 4B are the actual electron micrographs taken. The emulsion temperature was lowered to 20° C. and the pH was lowered to 3.0 with 3N sulfuric acid. Then polyvinyl alcohol o-sulfobenzaldehyde acetal was slowly added to coagulate the emulsion. After settling, the water containing the salts was removed be decantation. For further removal of unwanted salts 2 l of 0.002N potassium chloride solution was added with stirring to the emulsion, which was then allowed to settle and the wash water removed by decantation. The emulsion was then redispersed with sufficient gelatin to give a gelatin to silver ratio of 0.52. pH was adjusted to 6.0.

A control emulsion was prepared using balanced double jet precipitation of a cubic silver iodobromide containing 1% iodide and doped with 0.01 mole % $Na_3RhCl_6$ and the pAg was maintained at 8.2. The precipitation was controlled to give an average grain volume of 0.01 $\mu m^3$ and an $\alpha$ of 0.25. The control emulsion was coagulated and washed in the same manner as the experimental emulsion.

Both emulsions were redispersed in aqueous gelatin and the pH adjusted to 7.5 and the pAg to 7.0. The control was fogged by adding, per mole of silver halide, $2.4\times10^{-7}$ mole of cesium thiadecaborane and $3.1\times10^{-4}$ mole of gold chloride stabilized with hydrochloric acid. The digestion temperature was 83° C. During digestion small samples were taken and test coated to determine when a fog level sufficient to give a density of 4.0 was obtained on development for a coating weight of about 40 mg of silver halide per square decimeter. The digestion time was 100 min. The crystals of the present invention were fogged in a similar manner except only $3.5\times10^{-8}$ mole of cesium thiadecaborane and $2\times10^{-7}$ mole of gold chloride were used per mole of silver halide. At the end of digestion for both emulsions the temperature was lowered to 35° C. and the pH was adjusted to 6.0 with sulfuric acid and the pAg was adjusted to 8.2 with potassium chloride. Cetyl betaine was added as a coating aid and glyoxal was added as a hardener. Sensitometric tests showed that the speed obtained with the crystals of the present invention was 220% that of the control and with equivalent Dmin and Dmax.

Selective reactivity of the corners relative to the main portion of the crystal provides an explanation for the lower quantities of fogging agents required to fog the crystals of the present invention in relation to the control. Previous results had until this time indicated that the control emulsion with rhodium impurity, used to promote photo electron capture, was capable of higher direct positive speed than other similar size crystals containing only silver halide; as a result the speed improvement for this unique crystal is indeed a surprising result.

EXAMPLE 2

When the direct positive emulsions of Example 1 were additionally sensitized per mole of the silver halide by 2.72 grams of 4-[(1,3-dimethylimidazo 4,5-b quinoxalin-2(3H)-ylidene) ethylidene]-2-methyl-3-phenyl-2-isoxazoline-5-one the same relative speed ratio was maintained, indicating the effectiveness of the present invention for either spectral or nonspectral sensitization.

EXAMPLE 3

Crystals of the present invention were produced as for the direct positive crystals of Example 1 except that the amount of iodide added in the first halide was varied. Compared to the 1.5% molar iodide content of Example 1 with a growth pAg of 8.6, a growth pAg of about 8.2 to 8.3 was needed in the 6% to 4% range of iodide content to achieve the desired morphology. Molar iodide contents as high as 20% were tried in the first halide solution, but above 10% the morphology was more poorly defined. Sensitimetric tests indicated that by controlling other parameters and varying only the iodide content for these new crystals, speed and fog (minimum density) increased while maximum density decreased for a given coating weight as iodide content was increased.

EXAMPLE 4

When the molar ratio between the tetradecahedral body and the corners was varied between 60-40 to 97-3, it was possible to produce hybrid crystals demonstrating the improved speed response characterizing the present invention. These experiments used either pure silver bromide or 1.5% silver iodobromide for the tetradecahedra and pure silver chloride and silver bromochloride mixtures for the corners. To maximize sensitometric speed response, the relative volume of the corners should be kept small since with other factors equal, a crystal with a 95-5 ratio would be about three times faster than one with an 80-20 ratio.

EXAMPLE 5

Attempts were made to increase the speed of the direct positive hybrid crystals a described in the previous examples through the incorporation of $RhCl_3$ or $Na_3RhCl_6$ during the precipitation process. It was determined that a growth pAg of 8.2 was required in order to obtain a well-defined crystal structure when $3\times10^{-5}$ moles of rhodium salt were added per mole of silver halide during the first halide addition. Although it was possible to successfully incorporate rhodium into the crystal structure, as determined by elemental analysis, there was no speed improvement and, surprisingly, crystals of the present invention made the same way and having identical silver halide composition showed the same sensitometric response both with and without rhodium doping. When rhodium was added during both the first and second halide additions, the sensitometric response became poorer than for crystals of the present invention without rhodium.

We claim:

1. In a process wherein silver iodobromide crystals are formed by precipitation under balanced double jet conditions, and subsequently the crystals are either sensitized with sulfur and gold sensitizers and used to form a high speed negative emulsion or the crystals are fogged and then used to produce a high speed direct positive, the improvement comprising precipitating the silver iodobromide crystals at a pAg of between about 8 and 9 and a temperature of 35°–50° C., with high agitation, to produce tetradecahedral crystals, followed by contacting said crystals with a solution of silver nitrate and a solution of ammonium or alkali metal chloride, bromide, or a mixture of both, at a temperature of 35°–50° C. and a pAg of 6 to 8, using high agitation, whereby silver bromide or silver chlorobromide is caused to deposit preferentially on the (111) surfaces of said tetradecahedral crystals, the molar ratio of the tetradecahedral body to the resulting corners being from 60-40 to 97-3.

2. The process of claim 1 wherein the molar ratio of the tetradecahedral body to the corners is 95-5.

3. The process of claim 1 or claim 2 wherein said balanced double jet conditions include a temperature of 37° to 44° C. and a stirrer speed above 250 rpm.

* * * * *